US007681498B2

(12) United States Patent
Mori

(10) Patent No.: US 7,681,498 B2
(45) Date of Patent: Mar. 23, 2010

(54) PRINTER

(75) Inventor: Tomiya Mori, Miyagi (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 201 days.

(21) Appl. No.: 11/513,121

(22) Filed: Aug. 31, 2006

(65) Prior Publication Data

US 2007/0144367 A1 Jun. 28, 2007

(30) Foreign Application Priority Data

Dec. 26, 2005 (JP) ..... 2005-372925

(51) Int. Cl.
*B41L 13/00* (2006.01)

(52) U.S. Cl. ..... 101/118; 101/117

(58) Field of Classification Search ..... 101/114, 101/116, 117, 118, 128.4, 129
See application file for complete search history.

(56) References Cited

U.S. PATENT DOCUMENTS 5,285,724 A * 2/1994 Kobayasi et al. ..... 101/120

FOREIGN PATENT DOCUMENTS

| | | |
|---|---|---|
| JP | 2004-155170 | 6/2004 |
| JP | 2004-198889 | 7/2004 |
| JP | 2005-154119 | 6/2005 |

OTHER PUBLICATIONS

Machine English translation of JP 2004-198889.*
Machine English translation of JP 2004-155170.*

* cited by examiner

*Primary Examiner*—Ren Yan
(74) *Attorney, Agent, or Firm*—Oblon, Spivak, McClelland, Maier & Neustadt, L.L.P.

(57) ABSTRACT

A printer of the present invention includes a print drum around which a master made by cutting a stencil is to be wrapped, an ink feeding device for feeding ink to the master wrapped around the print drum and a pressing member for pressing a sheet relatively to the print drum to thereby print an image on the sheet. The operator of the printer is capable of selecting either one of a usual print mode and a silence print mode that give priority to image quality and noise reduction, respectively.

14 Claims, 10 Drawing Sheets

CORRECTION IN SILENCE PRINT MODE

PRINTER

BACKGROUND OF THE INVENTION

1. Field of the Invention

The present invention relates to a printer of the type printing an image on a sheet by pressing the sheet against a print drum with pressing means.

2. Description of the Prior Art

A thermosensitive, digital master making type of stencil printer is known as a simple, convenient printer. A stencil for use with this type of printer has a laminate structure made up of a porous support implemented by Japanese paper fibers, synthetic fibers or a mixture thereof and a thermoplastic resin film (simply film hereinafter) adhered to the support.

The above stencil printer includes a thermal head or similar heating unit including a number of heat generating devices. When the film surface of the stencil is in contact with the thermal head, the thermal head is moved in the main scanning direction in accordance with image data representative of a document image read by a scanner or image data received from a personal computer or a computer, selectively perforating, or cutting, the stencil with the heating devices to thereby make a master. The master thus made is automatically wrapped around the circumference of a cylindrical, porous print drum while being moved in the subscanning direction by a platen roller or similar master conveying means.

Subsequently, ink is fed from ink feeding means arranged inside the print drum to the master while a sheet is fed from a sheet feeding section toward the print drum. The sheet is continuously pressed against the print drum via the master by a press roller, press drum or similar pressing means, so that the ink is transferred to the sheet via the porous portion of the print drum and perforations formed in the master to thereby print an image on the sheet. The sheet thus adhered to the print drum by the adhesion of the ink is peeled off from the print drum by an air knife or blowing/peeling means implemented by a fan and then driven out to a print tray.

The stencil printer of the type described has some problems left unsolved, as will be described hereinafter. If much ink penetrates the master wrapped around the print drum, the amount of ink to be transferred to the sheet increases and brings about an occurrence that the image printed on the sheet runs or that when consecutive printed sheets are stacked, the ink on the underlying sheet is transferred to the reverse surface of the overlying sheet (so-called offset). On the other hand, if the amount of ink penetrated the master is short, then the amount of ink transferred to the sheet is also short, tending to cause the image on the sheet to blur.

Paying attention to the fact that the problems stated above are greatly dependent on the viscosity of the ink and the pressing force of the pressing means, Japanese Patent Laid-Open Publication No. 2004-155170 proposes a stencil printer capable of allowing the pressing force and other various conditions to be set for realizing high image quality.

Generally, a stencil printer includes some mechanisms that produce noise, e.g., contact noise ascribable to hitting of a press roller, which is a specific form of the pressing means, against the print drum, air blow noise and sheet feed noise. Such noise is particularly great when the pressing force of the press roller is increased or when print speed is high. However, the noise particular to printing operation has not been discussed in the past because the stencil printer has, in many cases, been used in an exclusive room.

On the other hand, the current tendency is toward a stencil printer including a controller that operates when the printer is connected to, e.g., a personal computer. Such a modern stencil printer is often situated in an ordinary office instead of an exclusive room, so that noise produced thereby is not negligible.

Technologies relating to the present invention are also disclosed in, e.g., Japanese Patent Laid-Open Publication Nos. 2005-154119 and 2004-198889

SUMMARY OF THE INVENTION

It is an object of the present invention to provide a stencil printer capable of reducing noise to occur during printing.

A printer of the present invention includes a print drum configured to wrap a master produced from a stencil therearound, an ink feeding device configured to feed ink to the master wrapped around the print drum, and a pressing member configured to press a sheet relatively to the print drum to thereby print an image on the sheet. Either one of a usual print mode and a silence print mode, respectively giving priority to image quality and noise reduction, is selectable.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
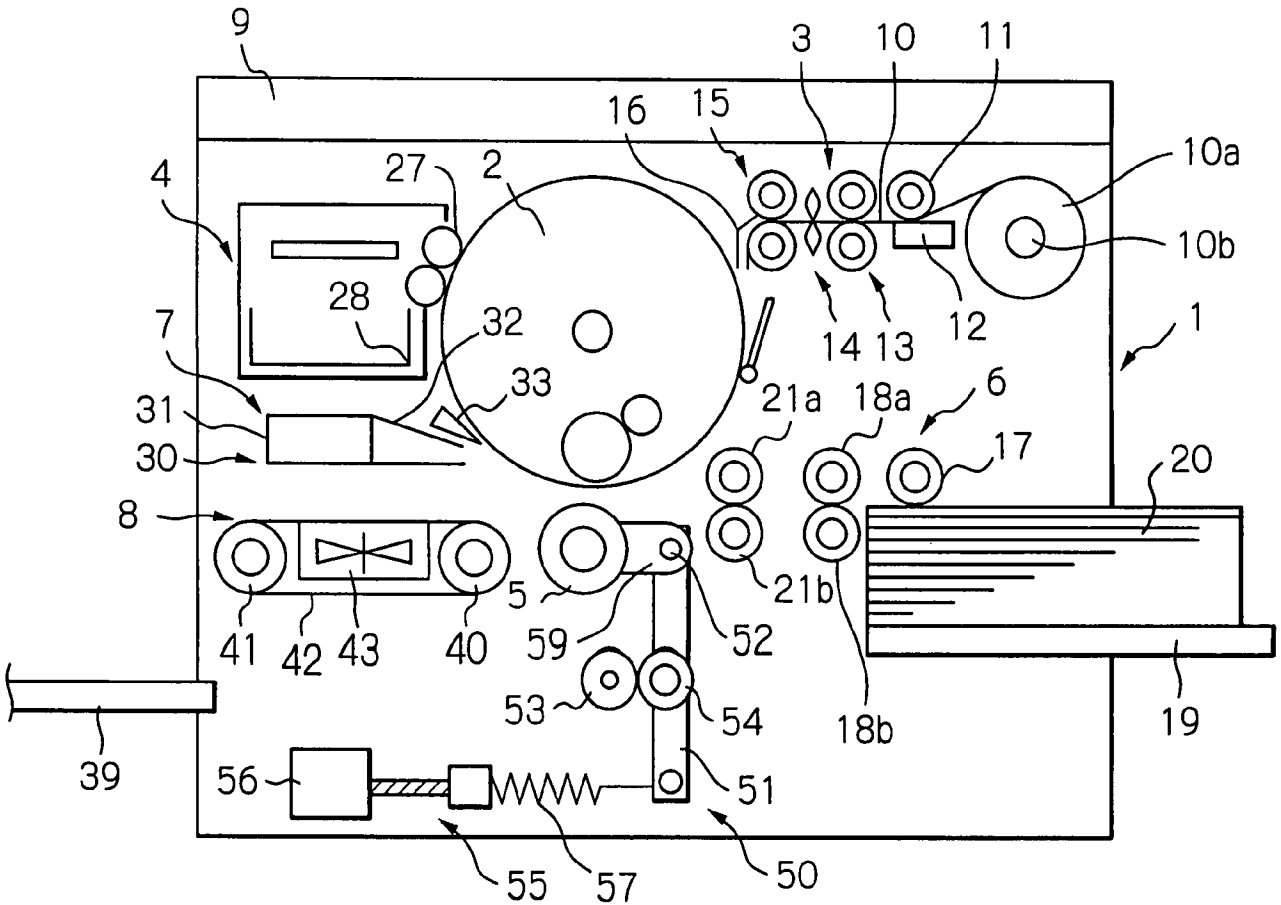
FIG. 1 is a sectional front view showing a preferred embodiment of the stencil printer in accordance with the present invention.

Referring to FIG. 1 of the drawings, a printer embodying the present invention is shown in a sectional front view and implemented as a stencil printer. The stencil printer includes a casing 1 in which a cylindrical, porous print drum 2 is disposed and driven to rotate about its axis. Arranged around the print drum 2 are a master making section 3, a master discharging section 4, a press roller or pressing member 5, a sheet feeding section 6 and a suction type conveying mechanism 8. A scanner 9 is positioned in the upper portion of the casing 1 and plays the role of a document reader.

The master making section 3 is configured to pay out a stencil 10*a* implemented as a roll and perforate, or cut, the stencil 10*a* with heat for thereby producing a master 10. The master making section 3 includes a shaft 10*b* supporting the stencil roll 10*a*, a platen roller 11 rotated by a stepping motor or drive source, not shown, a thermal head or master making means 12 pressed against the circumference of the platen roller 11 and including a number of heat generating devices, a roller pair 3 for conveyance, a cutter 14, a turn roller pair 15 and a guide plate 16.

In operation, the platen roller 11 is rotated to pay out the stencil 10*a* from the roll until the stencil 10*a* has been nipped by the platen roller 11 and thermal head 12. At this instant, the heat generating devices included in the thermal head 12 are selectively energized in accordance with image data representative of a document read by the scanner 8, perforating the stencil 10*a* to produce the master 10. After the master 10 thus produced has been conveyed by the roller pair 13 and turn roller pair 15, it is cut at a preselected length by the cutter 14.

The master discharging section 4 is configured to peel off a used master 10 from the print drum 2 and then discard it. For this purpose, the master discharging section 4 includes a peel roller 27 and a waste master box 28 for storing the used master 10 thus discarded.

The sheet feeding section 6 includes a pickup roller 17 and a pair of separation rollers 18*a* and 18*b* each being driven by a particular stepping motor or drive source, not shown, mounted on the respective shaft. In the event of printing, the pickup roller 17 and separation rollers 18*a* and 18*b* cooperate to pay out a single sheet from the top of a sheet stack 20 loaded on a tray and convey it toward a pair of registration rollers 21*a* and 21*b* located at the downstream side in the direction of sheet conveyance. The registration rollers 21*a* and 21*b* further conveys the sheet toward a nip between the print drum 2 and the press roller 5.

The peeling section 7 is generally made up of an air knife 30 and a peeler 33. The air knife 30 includes a fan or airflow control means or device 31 and an air knife or blowing/peeling means or device 30 implemented as a duct 32, which is configured to regulate a stream of air sent from the fan 31. In operation, the sheet 20, pressed against the print drum 2 by the press roller 5 and adhered to the surface of the print drum 2 by the adhesive force of ink, is peeled off by the peeler 33 and air knife 30 and then stacked on a print tray 39.

The suction type conveying mechanism 8 is configured to convey the sheet or print 20 peeled off from the print drum 2 by the air knife 30 to the print tray 39. The conveying mechanism 8 includes a pair of rollers 40 and 41 at least one of which is driven by a drive source, not shown, an endless belt 42 passed over the rollers 40 and 41, and a suction fan 43 for sucking the sheet 20 onto the belt 42.

The press roller or pressing member 5 is movable between a position spaced from the circumference of the print drum 2, FIG. 1, and a position contacting it. More specifically, the press roller 5 is rotatably supported by one end of a pair of first press arms 59 and exerts, when contacting the print drum 2, a pressing force on the print drum 2, more specifically the master wrapped around the print drum 2. The other end of each first press arm 59 is affixed to an arm shaft 52 which is rotatable about its axis. A second press arm 51 is affixed at one end thereof to one end of the arm shaft 52 while one end of a spring 57 is anchored to the other end of the second press arm 51. The other end of the spring 57 is implemented as a female screw. A press motor 56 has an output shaft part of which is implemented as a screw meshing with the female screw of the spring 57, as illustrated.

A cam follower 54 is rotatably supported by substantially the intermediate portion of the press arm 51 while a press cam 53 is positioned in the vicinity of the cam follower 54 and so configured as to rotate in synchronism with the print drum 2 and contact the cam follower 54 at preselected timing. The first press arms 51 and second press arm 59 are constantly biased by biasing means, not shown, in a direction in which they press the press roller 5 against the circumference of the print drum 2.

Figure 2:
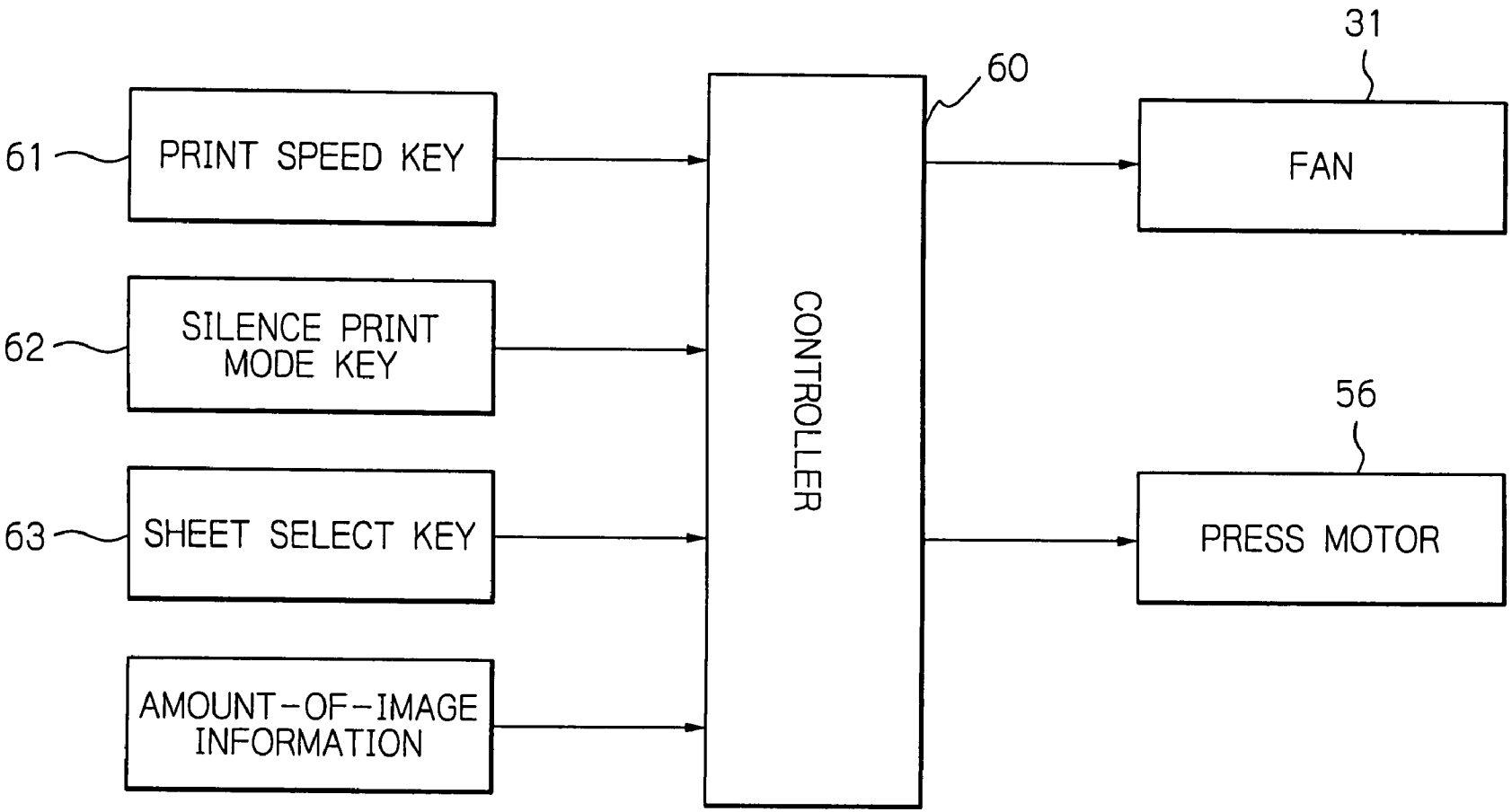
FIG. 2 is a block diagram schematically showing a control system included in the illustrative embodiment.

Pressure control means or device 55 drives the press motor or drive source 56 in accordance with a signal output from a controller 60, FIG. 2, to cause the spring 57 to selectively extend or contract. The first press arms 59 and second press arm 51 are angularly moved about the arm shaft 52 in accordance with the extension and contraction of the spring 57, so that the pressing force of the press roller 5 to act on the print drum 2 is automatically controlled, or varied, by the rotation of the press cam 53.

More specifically, in the pressing section 50, when the press cam 53 in rotation is brought into contact with the cam follower 54, the first press arms 59 and 51 are angularly moved counterclockwise, as viewed in FIG. 1, about the arm shaft 52, releasing the press roller 5 from the print drum 2. When the press cam 53 in rotation is released from the cam follower 54, the press arms 51 and 59 are angularly moved clockwise, as viewed in FIG. 1, by the force of the biasing means with the result that the press roller 5 is pressed against the print drum 2. Further, when the press motor 56 is driven to cause the spring 32 to extend or contract, the press arms 51 and 59 are angularly moved about the arm shaft 52 to move the press roller 5 in the contact/release direction. With this configuration, the pressing section 50 is capable of controlling the force with which the press roller 5 is pressed against the print drum 2.

FIG. 2 is a schematic block diagram showing a specific configuration of a control system included in the illustrative embodiment. As shown, the controller 60 mentioned previously is included in the control system as a major constituent and implemented as a microcomputer including a CPU (Central Processing Unit) and a memory, although not shown specifically. Connected to the input side of the controller 60 are the fan 31, the press motor 56, a print speed key or print speed setting portion 61, a silence print mode key 62 allowing the operator of the printer to select a silence print mode instead of a usual print mode that gives priority to image quality, and a sheet select key 63. The print speed key 61, silence print mode key 62 and sheet select key 63 are arranged on a control panel, not shown, mounted on the casing 1, FIG. 1.

Further, five stepwise rotation speeds, for example, of the print drum 2, which determine print speeds, are set in the controller 60 beforehand. When the operator selects any one of the five rotation speeds or print speeds, the controller 60 causes the sheet feeding section 6, peeling section 7, conveying mechanism 8 and pressing section 50 to operate in matching relation to the print speed selected. Assuming that the five print speeds are the first speed to the fifth speed, then the first and fifth speeds are the lowest and highest speeds, respectively.

Figure 3:
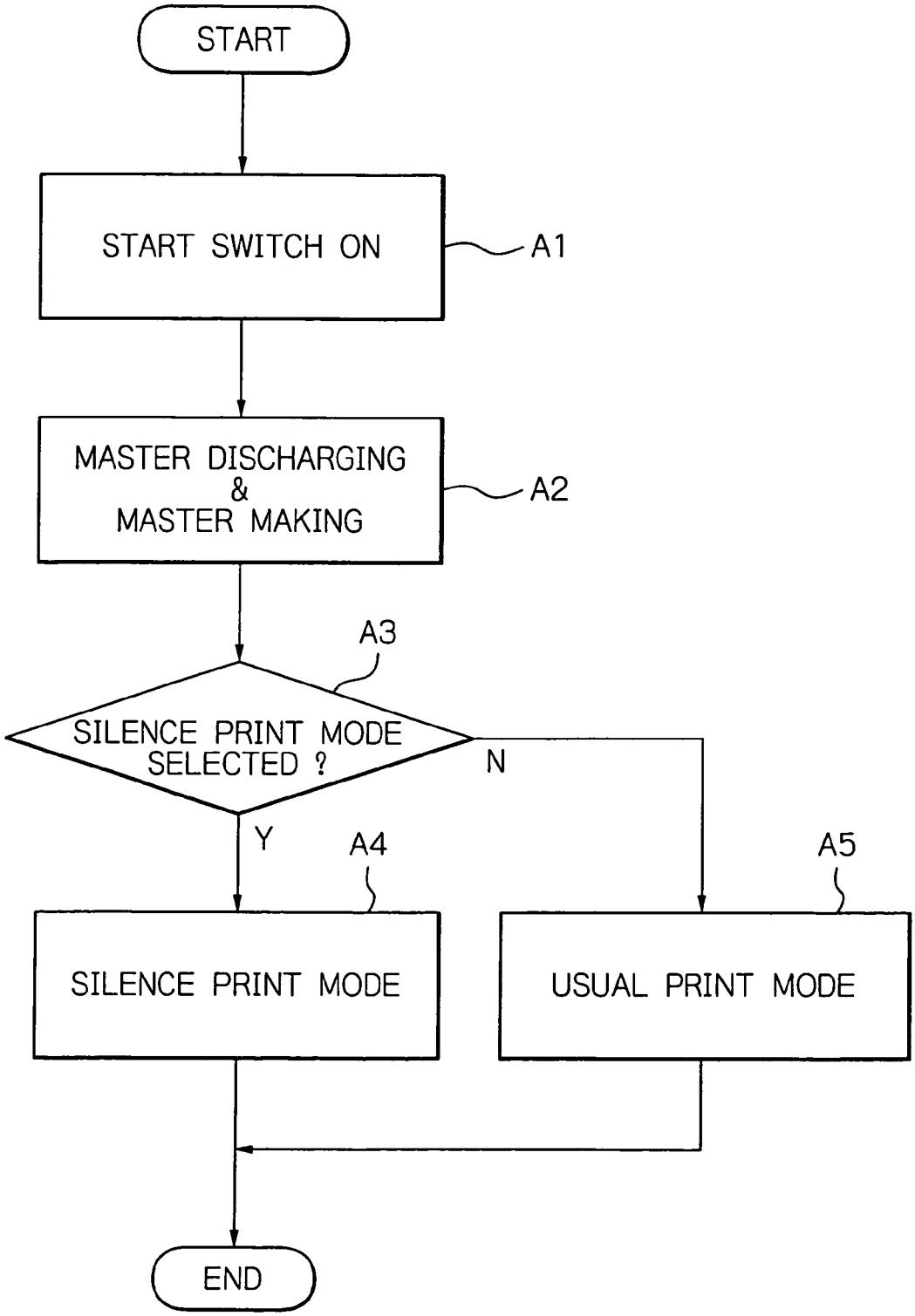
FIG. 3 is a flowchart demonstrating a specific procedure for establishing either one of a usual print mode and a silence print mode unique to the illustrative embodiment.

A usual print mode operation and a silence print mode operation unique to the illustrative embodiment will be described more specifically hereinafter. FIG. 3 is a flowchart demonstrating a specific operation of the controller 60 for selectively establishing the usual print mode or the silence print mode. As shown, when the operator pushes a start button, not shown, also arranged on the control panel (step A1), the master discharging section 4 discharges a used master 10 wrapped around the print drum 2 while the master making section 3 makes a new master 10 and wraps it around the print drum 2 (step A2). Subsequently, when the operator pushes the silence print mode key 62, the controller 60 determines whether or not the silence print mode is selected (step A3). If the silence mode is not selected (N, step S3), then the controller 60 establishes the usual print mode (step A5).

Figure 4:
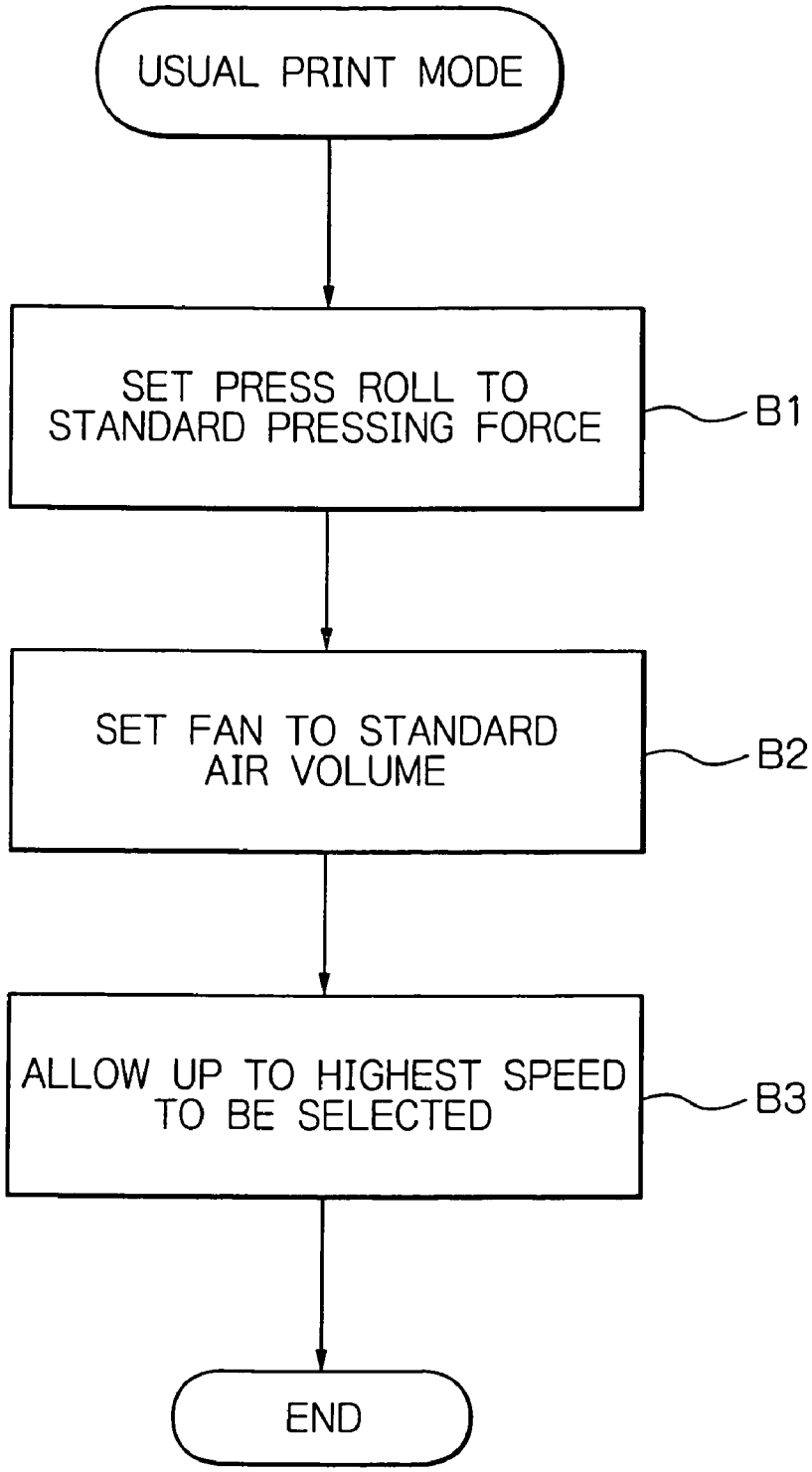
FIG. 4 is a flowchart showing specific processing for executing usual print mode operation included in the flowchart of FIG. 3.

FIG. 4 shows a specific procedure to be executed by the controller 60 in the usual print mode (step A5, FIG. 3). As shown, the controller 60 operates the press motor 56 in such a manner as to provide the press roller 5 with a standard pressing force assigned to the usual print mode, e.g., 20 kgf (step B1).

After the step B1, the controller 60 operates the fan 31 such that air is sent from the air knife 30 in a standard volume (step B2). In the illustrative embodiment, the controller 60 controls the rotation speed of the fan 31 for the above purpose. The controller 60 then allows the operator to select any one of the highest print speed to the lowest print speed (step B3). For example, the controller 60 may display the first to fifth speeds on a touch panel type of display, not shown, to allow the operator to select any one of them on the display or may allow the operator to input any one of the first to fifth print speeds on a print speed key or keys or print speed setting means.

It should be noted that the pressing force, air volume and print speed assigned to the usual print mode are so selected as to protect images printed on the sheets 20 from blurring beforehand, thereby surely providing even solid images with high quality. Stated another way, in the usual print mode, there are selected the steps of from master wrapping to printing that give priority to image quality and print speed, compared to the silence print mode.

More specifically, the air knife 30 starts blowing air while the sheet feeding section 6 starts paying out a single sheet 20 from the sheet tray 19. After the new master 10 has been wrapped around the print drum 2, the sheet 20 is pressed against the print drum 2 by the press roller 5 with the result that an image formed in the master 10 is transferred to the sheet 20. At this instant, the sheet 20 is peeled off from the drum 2 by air sent from the air knife 30 and then driven out to the print tray 39 by the suction type conveying mechanism 8. Consequently, the master 10 is closely adhered to the circumference of the print drum 20. At this time, the various sections of the printer are operated at an exclusive speed for the above step lower than the print speed selected by the operator. Subsequently, a printing operation is executed at the print speed selected by the operator.

Figure 5:
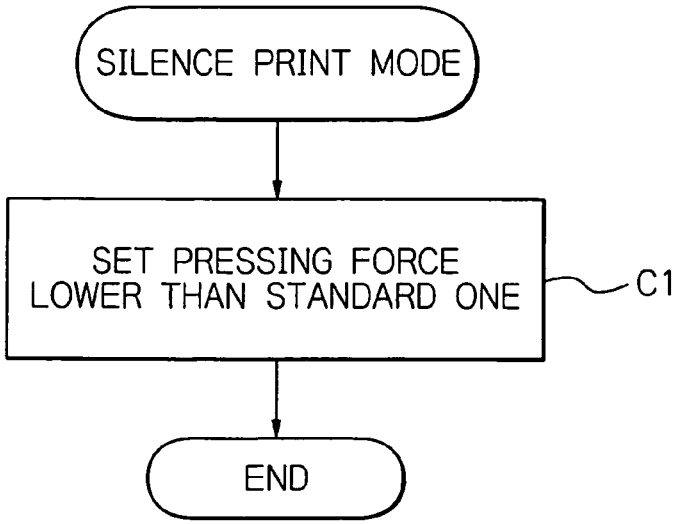
FIG. 5 is a flowchart showing specific processing for executing silence print mode operation, particularly pressing force control, also included in the flowchart of FIG. 3.
Figure 6:
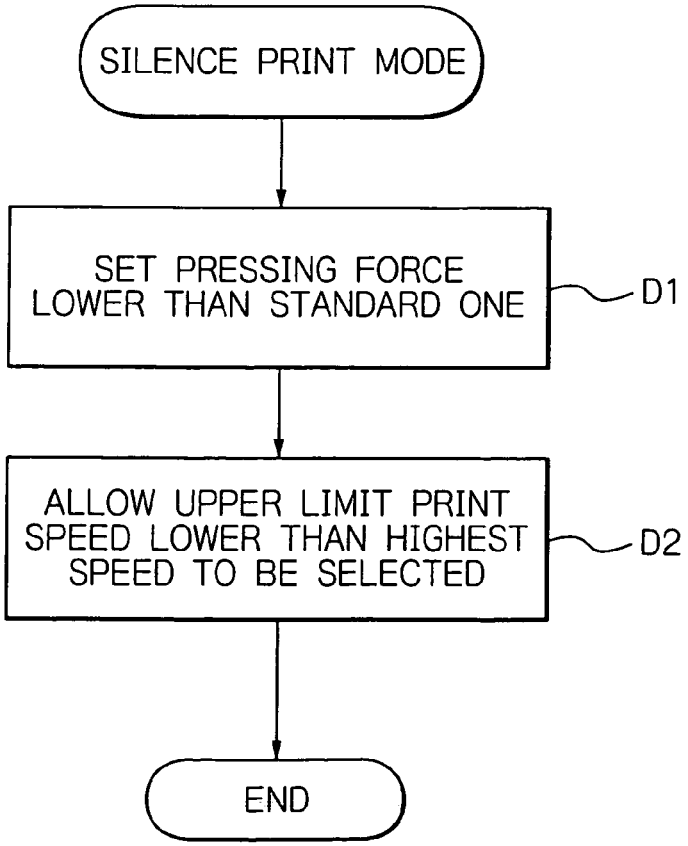
FIG. 6 is a flowchart showing specific processing for executing the silence print mode operation of FIG. 3, particularly pressing force control and print speed control.
Figure 7:
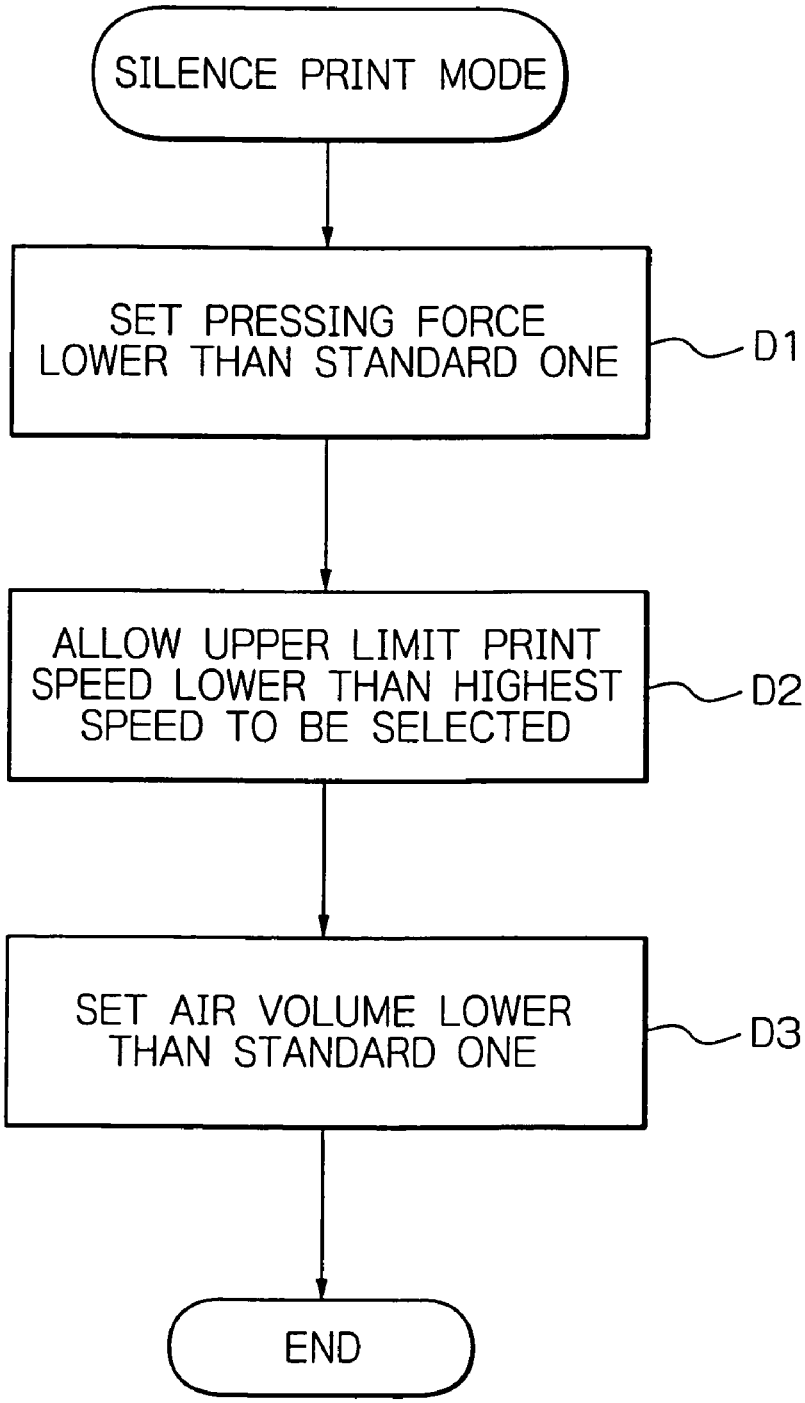
FIG. 7 is a flowchart showing specific processing for executing the silence print mode operation of FIG. 3, particularly pressing force control, print speed control and air volume control.

Reference will be made to FIGS. 5, 6 and 7 for describing specific procedures to be executed by the controller 60 in the silence print mode (step A4, FIG. 3). FIG. 5 shows a procedure in which the controller 60 operates to lower the pressing force assigned to the press roller 5. As shown, the controller 60 drives the press motor 56 in such a manner as to provide the press roller 5 with a pressing force of, e.g., 10 kgf lower than the standard pressing force of 20 kgf adapted for the usual print mode (step C1).

As stated above, when the silence print mode is selected, the press motor 56 is so operated to lower the pressing force of the press roller 5 for thereby reducing noise ascribable to the contact of the press roller 5 with the print drum 2.

FIG. 6 shows a procedure in which the controller 60 operates to limit the pressing speed to be assigned to the press roller 5 and the upper limit of the print speed. As shown, the controller 60 provides the press roller 5 with a pressing force of, e.g., 10 kgf lower than the standard pressing force of 20 kgf via the press motor 56 as in the step C1 of FIG. 5 (step D1). The controller 60 then allows the operator to select a print speed lower than the fifth or highest print speed, e.g., the third speed (step D2). For example, the controller 60 may display the first to third speeds on a touch panel type of display or may allow the operator to input desired one of the first to third speeds on a print speed key or print speed setting means not shown.

By limiting the upper limit of the print speed in the silence print mode, as stated above, it is possible to reduce noise to be output from the printer during high-speed printing. Moreover, while a blurred image is generally apt to occur when the print speed is high and must be coped with by increasing the pressing force, the silence print mode, which executes printing with a relatively low pressing force, realizes both of noise reduction and high image quality free from blurring by limiting the print speed.

FIG. 7 shows a procedure in which the controller 60 not only limits the pressing force to be assigned to the press roller 5 and upper limit of the print speed, but also establishes a volume of air to be sent from the air knife 30 lower than a standard volume. As shown, the controller 60 again provides the press roller 5 with a pressing force of, e.g., 10 kgf lower than the standard pressing force of 20 kgf via the press motor 56 (step D1) and then allows the operator to select a print speed lower than the fifth or highest print speed, e.g., the third speed (step D2). For example, the controller 60 may display the first to third speeds on a touch panel type of display or may allow the operator to input desired one of the first to third speeds on a print speed key or print speed setting means not shown, as stated previously.

After the step D2, the controller 60 operates the fan 31 in such a manner as to make the volume of air to be sent from the air knife 30 lower than a standard volume, which is assigned to the usual print mode (D3). For this purpose, in the illustrative embodiment, the controller 60 lowers voltage to be input to the fan 31 in order to make the rotation speed of the fan 31 lower than one implementing the standard volume of air.

Thus, by operating the fan 31 in such a manner as to reduce the volume of air to be sent from the air knife 30 in the silence print mode, it is possible to reduce noise ascribable to the fan 31 and therefore further reduce noise to be generated during printing. In addition, lowering voltage to be applied to the fan 31 is successful to save power and therefore to implement energy-saving printing.

More specifically, in the silence print mode processing shown in FIG. 7, the air knife 30 starts blowing air while the sheet feeding section 6 starts paying out a single sheet 20 from the sheet tray 19. After the new master 10 has been wrapped around the print drum 2, the sheet 20 is pressed against the print drum 2 by the press roller 5, which exerts a pressing force lower than the standard one, with the result that an image formed in the master 10 is transferred to the sheet 20 with a minimum of noise ascribable to the contact of the press roller 5 with the print drum 2.

Subsequently, the sheet 20 is peeled off from the drum 2 by a limited volume of air sent from the air knife 30 and therefore with a minimum of noise ascribable thereto. The sheet 20 thus peeled off is driven out to the print tray 39 by the suction type conveying mechanism 8. Consequently, the master 10 is closely adhered to the circumference of the print drum 20. At this time, the print speed lower than one assigned to the usual print mode is established, so that both of noise reduction and high image equality free from blur are achievable.

In the illustrative embodiment, the volume of air to be sent from the air knife 30 is controlled in terms of the rotation speed of a single fan 31. If desired, the fan 31 may be replaced with, e.g., two fans, in which case both fans will be driven in the usual print mode in order to implement the standard volume of air or only one of them will be driven in the silence print mode in order to make the volume of air lower than the standard one.

While the volume of air from the air knife 30 must be increased with an increase in pressing force and therefore in the adhesion of ink to the sheet 20, the illustrative embodiment reduces the pressing force of the press roller 5 in the silence print mode and can therefore reduce the adhesion of ink, thereby allowing the volume of air to be reduced.

A modification of the illustrative embodiment will be described with reference to FIGS. 8 and 9. While the illustrative embodiment described above lowers the pressing force of the press roller 5 in the silence print mode, an excessively low pressing force would bring about various image defects including granularity. Such image defects are particularly conspicuous in the case of a solid image or a sheet with a relatively rough surface. In light of this, the modification to be described hereinafter is configured to lower at least one of the pressing force of the press roller 5, the upper limit of the print speed and the air volume of the fan 31 in the silence print mode.

Figure 8:
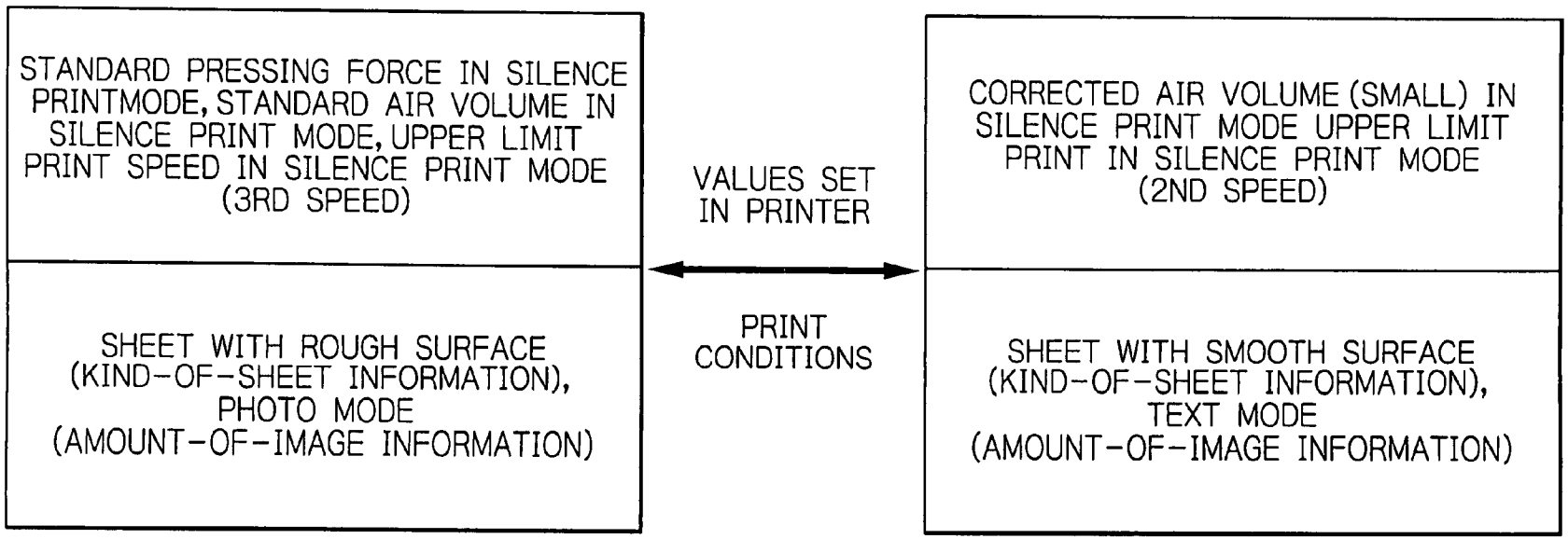
FIG. 8 is a schematic block diagram showing contents to be corrected in the silence print mode.

More specifically, as shown in FIG. 8, assume that information representative of a desired kind of sheets and input on the sheet select key 63, FIG. 2, are indicative of sheets with relatively rough surfaces. Then, in the modification of the illustrative embodiment, the controller 60, FIG. 2, selects the standard pressing force assigned to the silence print mode and the standard volume of air from the fan 31 in the silence print mode, but lowers the upper limit of the print speed from the fifth speed to the third speed, as stated previously.

On the other hand, as also shown in FIG. 8, if the information input on the sheet select key 63 is representative of sheets with relatively smooth surfaces, then the standard pressing force assigned to the master making and printing mode would be excessively strong. To solve this problem, the controller 60 lowers the above standard pressing fore to a corrected pressing force via the press motor 56, lowers the standard air volume of the fan 31 assigned to the silence print mode to a corrected air volume, and further lowers the upper limit of the print speed from the third speed, which is the highest speed in the silence print mode, to the second speed.

As for the image data, the controller 60 counts the number of pulses input to the thermal head 12 included in the master making section 3, i.e., the number of times of heat generation by the heat generating devices of the thermal head 12. If the count is small, then the controller 60 determines that the area of solid images is small while the area of text images is great, and lowers the reference pressing force to the corrected pressing force via the press motor 56. In addition, the controller 60 lowers the air volume of the fan 31 and the upper limit of the print speed.

In an alternative arrangement also available with the modification, when a text/photo mode key or similar image quality select key is pressed by the operator to select, e.g., a photo mode, the controller 60 determines that image data is representative of a solid image, and then controls the pressing force of the press roller 5, air volume of the fan 31 and upper limit of the print speed to the standard pressing force, standard air volume and standard highest print speed or third print speed, respectively. On the other hand, in a text mode, as distinguished from the photo mode, the controller 60 makes the pressing force of the press roller 5, air volume of the fan 31 and the upper limit of print speed lower than the standard pressing force, standard air volume and standard maximum speed or third speed, respectively.

Figure 9:
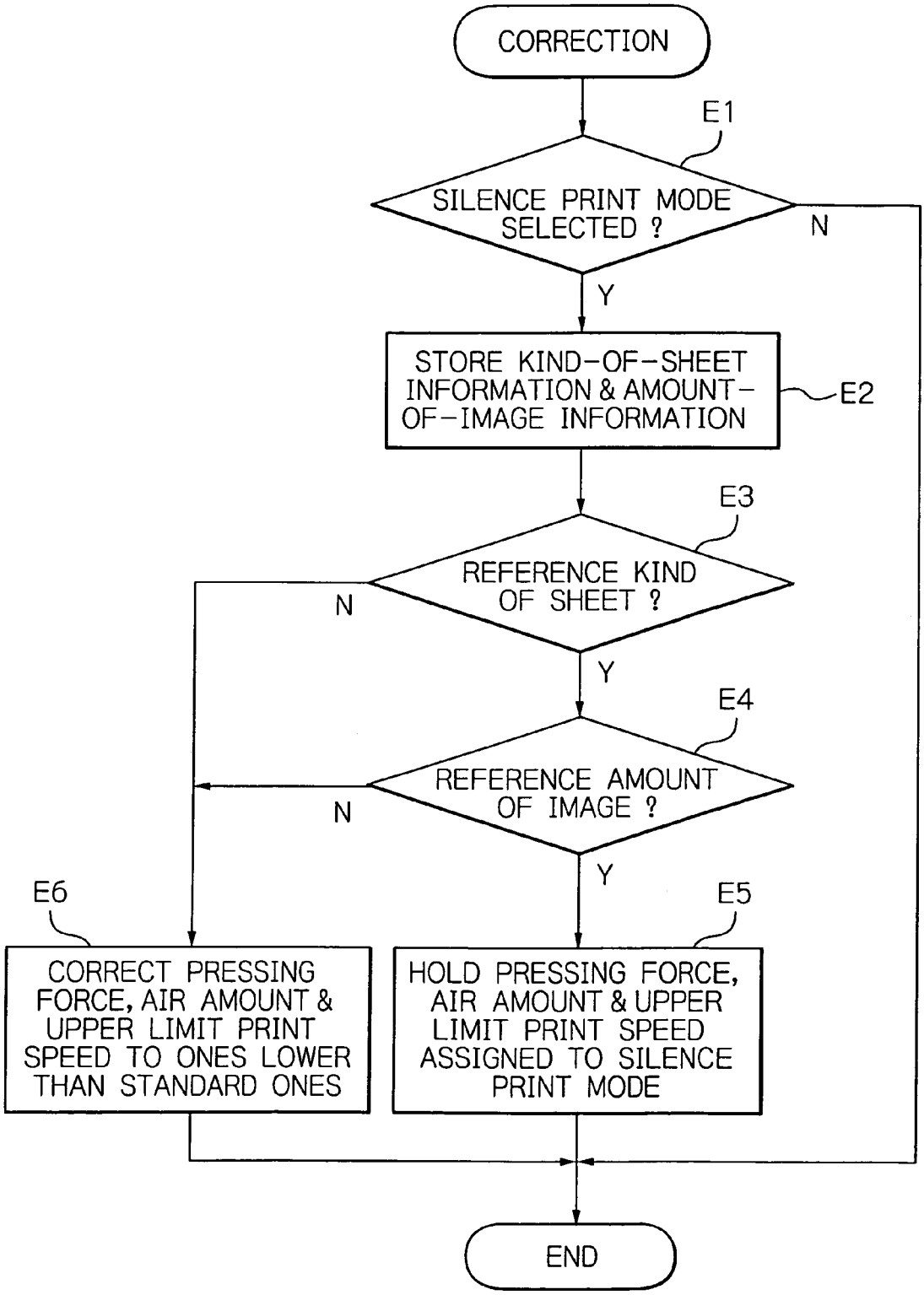
FIG. 9 is a flowchart demonstrating a specific correction procedure to be executed in the silence print mode.
Figure 10:
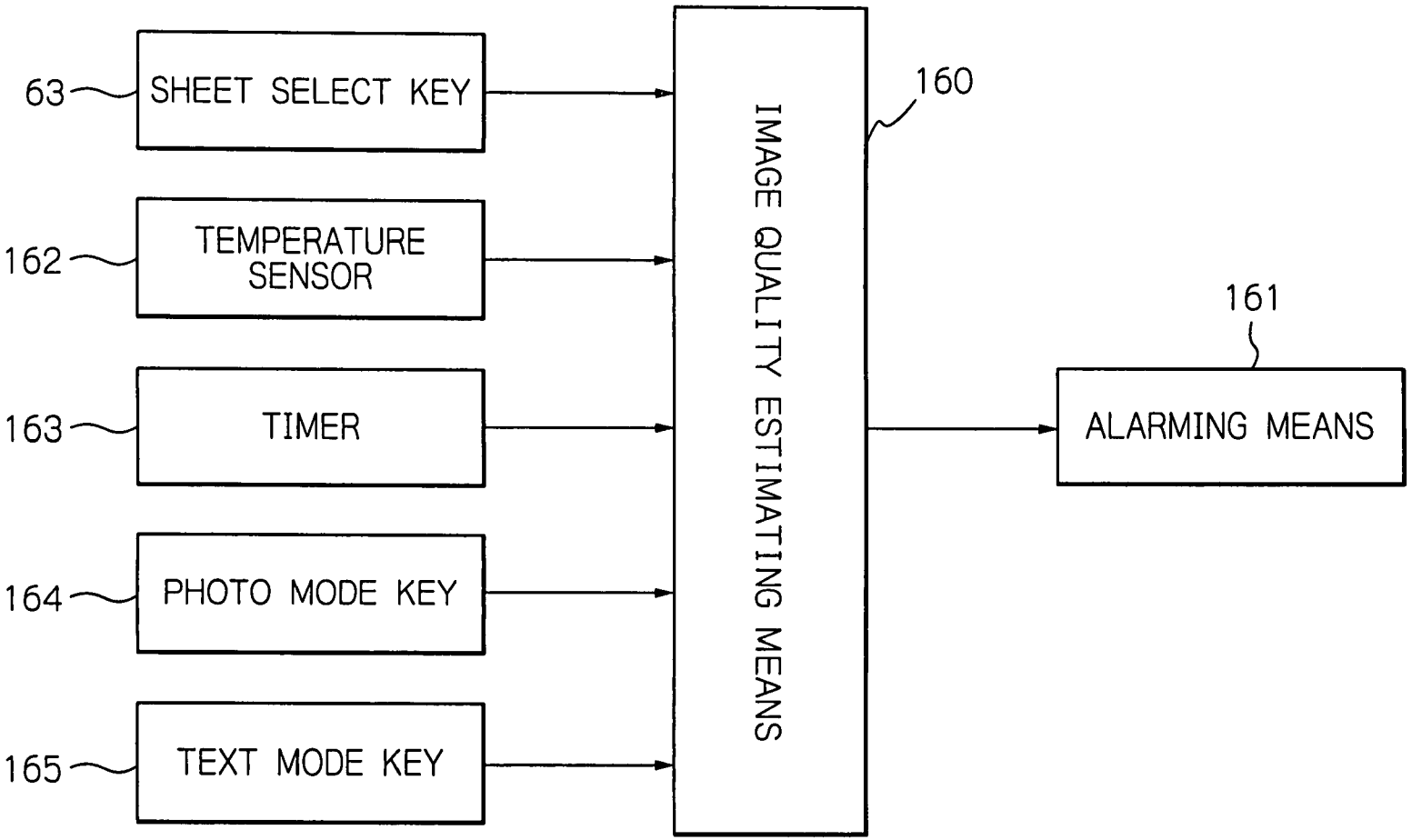
FIG. 10 is a schematic block diagram showing an alternative configuration of the control system.

FIG. 9 is a flowchart showing a specific correction procedure to be executed by the controller 60 in the silence print mode. As shown, the controller 60 determines whether or not the silence print mode is selected (step E1). If the silence mode is selected (Y, step E1), then the controller 60 reads the kind-of-sheet information and amount-of-image information (step E2). Subsequently, the controller 60 determines whether or not the actual kind-of-sheet information and amount-of-image information thus read are equal to respective reference values stored in the memory of the controller 60 beforehand (steps E3 and E4). In this modification, a preselected sheet with a relatively rough surface and a photo mode are selected as the reference kind-of-sheet information and reference amount-of-image information, respectively.

If the answer of the step E3 is Y, meaning that a sheet with a relatively rough surface is selected, and if the answer of the step E4 is Y, meaning that the photo mode is selected, then the controller 60 maintains the standard pressing force, standard air volume of the air knife 30 and standard highest print speed. On the other hand, if the answer of the step E3 is N, meaning that a sheet with a relatively smooth surface, or if the answer of the step E4 is N, meaning that the text mode is selected, then the controller 60 corrects the pressing force, air volume of the air knife 30 and highest print speed to those lower than the standard ones and ends the procedure of FIG. 9.

While the illustrative embodiment and modification thereof select, a pressing force and other conditions that minimize the blur of an image in accordance with the amount of an image or the kind of a sheet, such conditions may alternatively be varied in accordance with, e.g., surrounding temperature or information representative of a period of time for which the print drum 2 is left unused (unused time hereinafter), as desired. Further, if the conspicuous blur is likely to occur in an image in the silence print mode as determined on the basis of, e.g., the amount of an image, then an alarm may be produced before the start of printing, as will be described hereinafter.

Figure 11:
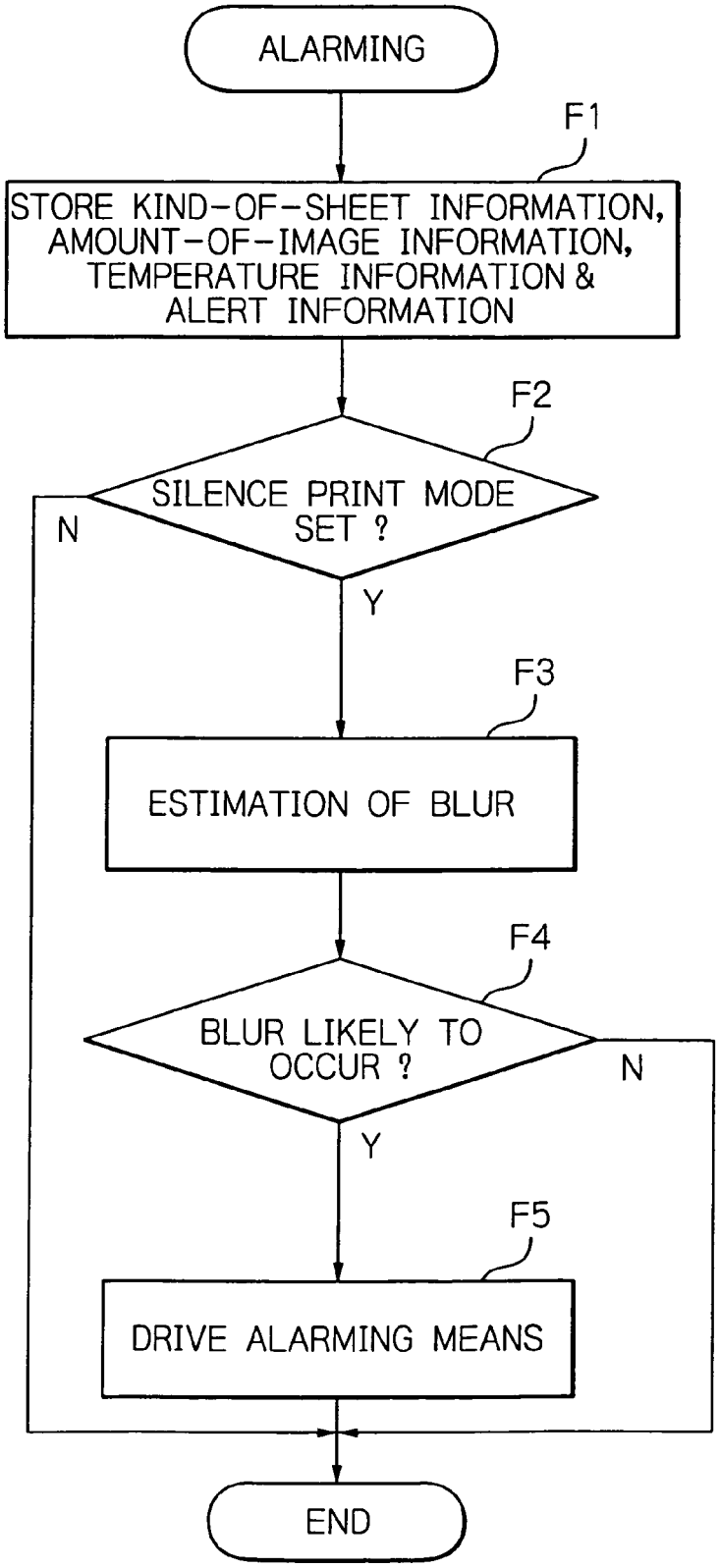
FIG. 11 is a flowchart showing a specific alarm procedure available with the control system of FIG. 10.

Reference will be made to FIG. 11 for describing another specific control system configured to minimize the blur of an image. As shown, the control system includes image quality estimating means or device 160 implemented by a conventional microcomputer. The image quality estimating means 160 may be constructed independently of or integrally with the controller 60, FIG. 2, a desired. Connected to the input side of the image quality estimating means 160 are the sheet select key 63, a temperature sensor 162 responsive to temperature or atmosphere information in the printer and a timer 163 for counting, as another atmosphere information, a period of time for which the print drum 2 is left unused. Further, a text mode key 164 and a photo mode key 165 are connected to the output side of the image estimating means.

Alarming means or device 161 is connected to the output side of the image quality estimating means 160 for producing an alarm before printing when blur is likely occur in the silence print mode selected by the operator. The alarm means may be any one of an LED (Light Emitting Diode), a buzzer, a voice, a display and other conventional indicators. Image blur information derived from the kind-of-sheet information input by the operator, temperature information, unused time information and amount-of-image information are stored in the image quality estimating means 160 beforehand.

FIG. 11 is a flowchart demonstrating a specific alarm procedure to be executed by the image quality estimating means 160. As shown, kind-of-sheet information, amount-of-image information, temperature information and unused time information are written to the image quality estimating means 160 (step F1). Subsequently, whether or not the silence print mode is selected by the operator is determined (step F2). If the answer of the step F2 is N, the image quality estimating means ends the procedure of FIG. 11. On the other hand, if the answer of the step F2 is Y, the procedure advances to a step F3.

In the step F3, the image quality estimating means 160 estimates whether or not the blur of an image will occur on the basis of the various information set therein, i.e., by comparing the above information with blur information stored in a memory not shown. If the answer of the step F4 is Y, then the image quality estimating means 161 drives the alarming means 161 (step F5) and then ends the procedure. If the answer of the step F4 is N, the image quality estimating means 160 also ends the procedure of FIG. 11.

As stated above, the image quality estimating means 160 estimates, when the silence print mode is selected, the blur of an image in accordance with at least one of kind-of-image information, amount-of-image information and atmospheric temperatures, which include temperature information and unused time information. If blur is likely to occur in the silence print mode, then the image quality estimating means drives the alarming means 161 to thereby alert the operator to the estimated blur before printing. It is therefore possible to reduce prints of low image quality while maintaining the noise level of the printer low.

In summary, it will be seen that the present invention achieves various unprecedented advantages, as enumerated below.

(1) Either one of a usual print mode and a silence print mode, respectively giving priority to image quality and noise reduction, can be selected, as desired. Stated another way, high-quality prints are achievable in the usual print mode while prints not needing high quality are achievable in the silence mode that reduces noise during printing.

(2) When the silence print mode is selected, pressure control means is so operated as to lower a pressing force for thereby controlling contact noise. This is successful to further reduce noise to occur during printing.

(3) When the silence print mode is selected, the upper limit of the print speed is lowered in order to reduce noise to occur during high-speed printing, thereby further reducing noise during printing. The higher the print speed, the higher the probability of blur and therefore the greater the required pressing force. In this respect, the silence print mode that originally effects printing with a small pressing force, it is possible to obviate blur by lowering the upper limit of the print speed.

(4) In the silence print mode, blowing/peeling means is operated to lower the volume of air to send and therefore capable of operating with low noise. This is successful not only to further reduce noise during printing but also to save power to be consumed by the blowing/peeling means.

(5) If the amount or area of an image represented by the amount-of-image information is smaller than a preselected reference value or if the kind of a sheet is difference from a preselected reference value, then at least one of the pressing force, upper limit of print speed and air volume selected in the silence print mode is corrected to the lower side for thereby further reducing noise during printing.

(6) Image quality estimating means estimates the blur of an image in accordance with at least one of kind-of-image information, amount-of-image information and atmosphere information while alarming means produces an alarm before printing if the blur of an image is likely to occur in the silence print mode. It is therefore possible to alert the operator to the estimated blur before printing for thereby reducing prints of low quality.

Various modifications will become possible for those skilled in the after receiving the teachings of the present disclosure without departing from the scope thereof.

What is claimed is:

1. A printer, comprising:

a print drum configured to wrap a master produced from a stencil therearound;

ink feeding means for feeding ink to the master wrapped around said print drum;

pressing means for pressing a sheet relatively to said print drum to thereby print an image on said sheet;

a controller configured to implement at least one of a usual print mode giving priority to image quality and a silence print mode giving priority to noise reduction, the usual print mode and the silence print mode both having a pressing force, an air volume, and a print speed associated therewith;

pressure control means for driving a press motor in accordance with a signal output from said controller to cause a spring to selectively extend and contract to vary a pressure force of said pressing means acting on said print drum; and a unit including at least one fan and blowing/peeling means for regulating a stream of air sent from said at least one fan, wherein said controller operates said press motor in such a manner as to provide said pressing means with a standard pressing force assigned to said usual print mode and to provide said pressing means with a reduced pressing force assigned to said silence print mode, said blowing/peeling means controls a rotation speed of said at least one fan such that a standard volume of air is sent from said at least one fan when the usual print mode is selected, and a lower standard volume of air is sent from at least one fan when the silence print mode is selected.

2. The printer as claimed in claim 1, wherein said blowing/peeling means peels off the sheet printed from said print drum with air, wherein when an amount of image represented by amount-of-image information input is smaller than a preselected reference value, at least one of the pressing force of said pressing means, an upper limit of a print speed and a volume of air to be sent from said blowing/peeling means in the silence print mode is corrected to a lower side.

3. The printer as claimed in claim 1, further comprising:

a sheet select key for inputting kind-of-sheet information representative of a desired kind of sheet, wherein the controller is further configured to reduce noise during printing by correcting to a lower side at least one of the pressing force of said pressing means, an upper limit of a print speed, and a volume of air to be sent from said blowing/peeling means in the silence print mode when said kind-of-sheet information is different from a preselected reference value, wherein the blowing/peeling means peels off the sheet printed from said print drum with air.

4. The printer as claimed in claim 1, wherein in the silence print mode an upper limit of the print speed is varied to a lower side.

5. The printer as claimed in claim 4, wherein said blowing/peeling means peels off the sheet printed from said print drum with air, wherein when an amount of image represented by amount-of-image information input is smaller than a preselected reference value, at least one of the pressing force of said pressing means, the upper limit of the print speed and a volume of air to be sent from said blowing/peeling means in the silence print mode is corrected to a lower side.

6. The printer as claimed in claim 4, wherein said blowing/peeling means peels off the sheet printed from said print drum with air, wherein when a kind of a sheet represented by kind-of-sheet information input is different from a preselected reference value, at least one of the pressing force of said pressing means, an upper limit of a print speed and a volume of air to be sent from said blowing/peeling means in the silence print mode is corrected to a lower side.

7. The printer as claimed in claim 1, further comprising:

image quality estimating means for estimating an occurrence of blur of an image in accordance with at least one of kind-of-sheet information, amount-of-image information and environment information; and alarming means for alerting, an operator of the printer when said image quality estimating means determines that blur of an image is likely to occur in the silence print mode.

8. A printer, comprising:

a print drum configured to wrap a master produced from a stencil therearound;

an ink feeding device configured to feed ink to the master wrapped around said print drum;

a pressing member configured to press a sheet relatively to said print drum to thereby print an image on said sheet; and a controller configured to implement at least one of a usual print mode giving priority to image quality and a silence print mode giving priority to noise reduction, the usual print mode and the silence print mode both having a pressing force, an air volume, and a print speed associated therewith;

a pressure control device configured to drive a press motor in accordance with a signal output from said controller to cause a spring to selectively extend and contract to vary a pressure force of said pressing member acting on said print drum; and a unit including at least one fan and blowing/peeling device configured to regulate a stream of air sent from said at least one fan, wherein said controller operates said press motor in such a manner as to provide said pressing member with a standard pressing force assigned to said usual print mode and to provide said pressing means with a reduced pressing force assigned to said silence print mode said blowing/peeling device is configured to control a rotation speed of said at least one fan such that a standard volume of air is sent from said at least one fan when the usual print mode is selected, and a lower standard volume of air is sent from at least one fan when the silence print mode is selected.

9. The printer as claimed in claim 8, wherein said a blowing/peeling device is configured to peel off the sheet printed from said print drum with air, wherein when an amount of image represented by amount-of-image information input is smaller than a preselected reference value, at least one of the pressing force of said pressing member, an upper limit of a print speed and a volume of air to be sent from said blowing/peeling device in the silence print mode is corrected to a lower side.

10. The printer as claimed in claim 8, further comprising:

a sheet select key for inputting kind-of-sheet information representative of a desired kind of sheet, wherein the controller is further configured to reduce noise during printing by correcting to a lower side at least one of the pressing force of said pressing member, an upper limit of a print speed, and a volume of air to be sent from said blowing/peeling device in the silence print mode when said kind-of-sheet information is different from a preselected reference value, wherein the blowing/peeling device is configured to peel off the sheet printed from said print drum with air.

11. The printer as claimed in claim 8, wherein in the silence print mode an upper limit of a print speed is varied to a lower side.

12. The printer as claimed in claim 11, wherein said blowing/peeling device is configured to peel off the sheet printed from said print drum with air, wherein when an amount of image represented by amount-of-image information input is smaller than a preselected reference value, at least one of the pressing force of said pressing member, the upper limit of the print speed and a volume of air to be sent from said blowing/peeling device in the silence print mode is corrected to a lower side.

13. The printer as claimed in claim 11, wherein said blowing/peeling device is configured peel off the sheet printed from said print drum with air, wherein when a kind of a sheet represented by kind-of-sheet information input is different from a preselected reference value, at least one of the pressing force of said pressing means, an upper limit of a print speed and a volume of air to be sent from said blowing/peeling device in the silence print mode is corrected to a lower side.

14. The printer as claimed in claim 8, further comprising:

an image quality estimating device configured to estimate an occurrence of blur of an image in accordance with at least one of kind-of-sheet information, amount-of-image information and environment information; and an alarming device configured to alert, an operator of the printer when said image quality estimating device determines that blur of an image is likely to occur in the silence print mode.

* * * * *